US007481716B1

(12) United States Patent
Johnson

(10) Patent No.: US 7,481,716 B1
(45) Date of Patent: Jan. 27, 2009

(54) GOLF CLUB GRIP FOR ACCOMMODATING SELECTABLE WEIGHT ASSEMBLY

(76) Inventor: John Johnson, 8359 Montgomery Ct., Ventura, CA (US) 93004

( * ) Notice: Subject to any disclaimer, the term of this patent is extended or adjusted under 35 U.S.C. 154(b) by 0 days.

(21) Appl. No.: 11/707,725

(22) Filed: Feb. 17, 2007

(51) Int. Cl.
*A63B 53/14* (2006.01)

(52) U.S. Cl. ..... 473/297

(58) Field of Classification Search ..... 473/295, 473/300–303, 282–286, 318, 297–299
See application file for complete search history.

(56) References Cited

U.S. PATENT DOCUMENTS 1,580,724 A * 4/1926 Harmon ..... 74/551.9
2,782,035 A * 2/1957 East ..... 473/297
2,960,133 A * 11/1960 Shepherd, Jr. ..... 81/22
3,779,559 A * 12/1973 Taylor ..... 473/285
4,826,168 A * 5/1989 McGuire et al. ..... 473/295
5,244,209 A * 9/1993 Benzel ..... 473/297
2006/0270488 A1* 11/2006 Takeuchi ..... 473/300

* cited by examiner

*Primary Examiner*—Stephen L. Blau
(74) *Attorney, Agent, or Firm*—J. E. McTaggart

(57) ABSTRACT

A golf club grip of conventional appearance and resilient material is configured internally at its upper end with a specialized hole for accommodating a counter-weight assembly, extending into the upper end of the shaft, that is user-selectable from various available weights, which may be added to the counter-weight assembly and secured in place by a machine screw, which tightened in place, compresses a compliant bushing expanding it radially against the inner wall of the shaft, locking the grip and counter-weight assembly to the shaft to act as a single unit. This configuration of counter-weight assembly known as "TOUR LOCK Technology" provides the ability to easily interchange counter-weight assemblies of different mass.

3 Claims, 7 Drawing Sheets

GOLF CLUB GRIP FOR ACCOMMODATING SELECTABLE WEIGHT ASSEMBLY

The disclosed subject matter relates to provisional patent application 60/773,606 filed Feb. 16, 2006.

FIELD OF THE INVENTION

The present invention relates to the field of sports equipment, and more particularly to the structure of a golf club grip adapted for carrying selectable weights in a counter-weight assembly, made and arranged to fit in the top of the golf club grip.

BACKGROUND OF THE INVENTION

There have been many approaches to golf club structure seeking greater distance and accuracy. For dynamic physical analysis, the golf club can be considered as three significant centers of mass, i.e. the handle, the shaft and the club head. The mass of the shaft has been reduced with the advent of modern lightweight shaft materials and technology, e.g. graphite and compounds thereof. It has been generally confirmed that, especially with such a lightweight shaft, better control, distance and accuracy can be obtained by counter-balancing the mass of the club head by the addition of mass at the grip end of the shaft, where an amount of mass can be selected to arrive at an optimal weight and feel for the individual player.

It is believed that any mass added should not be placed in direct metal-to-metal interface contact with the golf club shaft, but instead there should be resilient but firm mounting via intervening material such as the rubber-like material of the grip to introduce a desirable damping factor.

DISCUSSION OF KNOWN ART

In recognition of the benefits of adding mass, i.e. weight, at the grip end of the golf club, there have been several different approaches in the prior art for adding weight to the grip end, however there are related factors that have not been taken fully into account.

The trend to lighter weight shafts and interchangeable heads is making it more beneficial and desirable to counter-balance the club head by the addition of an optimal amount of mass strategically located in the handle region.

Locating a weighted plug and selectable weights in the top of a golf club grip allows a golfer to modify the center of mass and distributed weight in a golf club, thereby improving the performance and comfort of a golf club to provide greater distance and accuracy.

Since there may be some empirical research required under non-competition conditions to determine the optimal amount of mass to add for the individual player and the particular golf club involved, it is important to be able to change the amount of mass conveniently. It is also important to avoid any looseness between the grip and the shaft or between the added mass and the shaft that could give rise to rattles or other insecurity.

Conventional golf grips, known in the art, may have a simple hole in the top to allow air to escape during installation.

None of the foregoing or other known art teach or suggest the structure or functional capability of the present golf club grip with a larger specialized hole in the top to accommodate a counter-weight assembly, particularly when combined with selectable weights and the damping characteristics of the present invention.

OBJECTS OF THE INVENTION

It is a primary object of the present invention to provide a golf club grip capable of receiving a variety of interchangeable counter-weight assemblies that can be readily installed on the shaft of an existing golf club.

It is a further object of the present invention to provide a counter-weight assembly structure that may be easily removed and adjusted, by means of a machine screw located on its center axis, to carry various selectable weights.

It is a further object that the weight can be selected from a group of weights with various mass values in a predetermined range, each of which can be readily deployed onto and removed from the grip.

It is a further object to ensure positive and secure fastening between the grip, the weight or weights and the shaft of the golf club.

It is a further object that allows golf grip to secure two or more weights that can be rotated or interchanged.

It is a further object to allow mass to be located and distributed along the shaft if desired.

It is a further object to avoid direct metal-to-metal attachment of the weight to the shaft, but instead to provide damping action by indirect attachment there between via resilient material such as the resilient material of the handle.

SUMMARY OF THE INVENTION

The foregoing objects have been met in a preferred embodiment of the present invention wherein an otherwise conventional resilient golf club grip is configured at its thicker upper end with a specialized hole for accommodating a removable counter-weight assembly, with selectable weights, that extends into the upper end of a hollow golf club shaft when inserted into the grip. The exposed grip end is configured to accommodate a variety of counter-weight assemblies, comprising a top plug element with a flange, selected weights, a machine screw located on the center axis holding the assembly together, and a threaded bushing set in place at the lower end of the counter-weight assembly. When the machine screw head at the top of the assembly is tightened, clamping action compresses entire assembly, including the threaded bushing that is made of a flexible material. When compressed, the threaded bushing expands radially against the inner wall of the golf club shaft, developing strong compressive frictional force that positively locks the grip and the entire counter-weight assembly in place, as one to the shaft. The mass can be controlled by the material in the top plug element, by an optional weight/cover located on top of the plug element, or by selectable weights located in the center of the counter-weight assembly, e.g. plastic or aluminum for lower mass, and steel, lead or tungsten for higher mass, to provide different versions that can be readily interchanged as required via the machine screw for deployment of different values of mass.

BRIEF DESCRIPTION OF THE DRAWINGS

The above and further objects, features and advantages of the present invention will be more fully understood from the following description taken with the accompanying drawings in which.

DETAILED DESCRIPTION OF THE DRAWINGS

Figure 1:
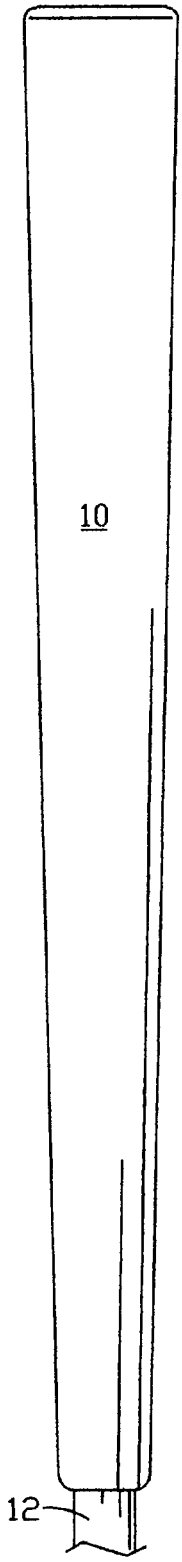
FIG. 1 shows a side elevation view of a golf grip in a preferred embodiment of the present invention.

FIG. 1 shows a side elevation view of a golf grip 10 for selectable counter-weights, representing a preferred embodiment of the present invention. The main body 10, fitted on the end of golf club shaft 12, is configured in a conventional coaxial shape, and is made from rubber or other resilient material found commonly in golf club grips. However, as is common in golf club grip designs, main body 10 may be formed in an asymmetrical shape to ergonomically conform to the users hands.

Figure 2:
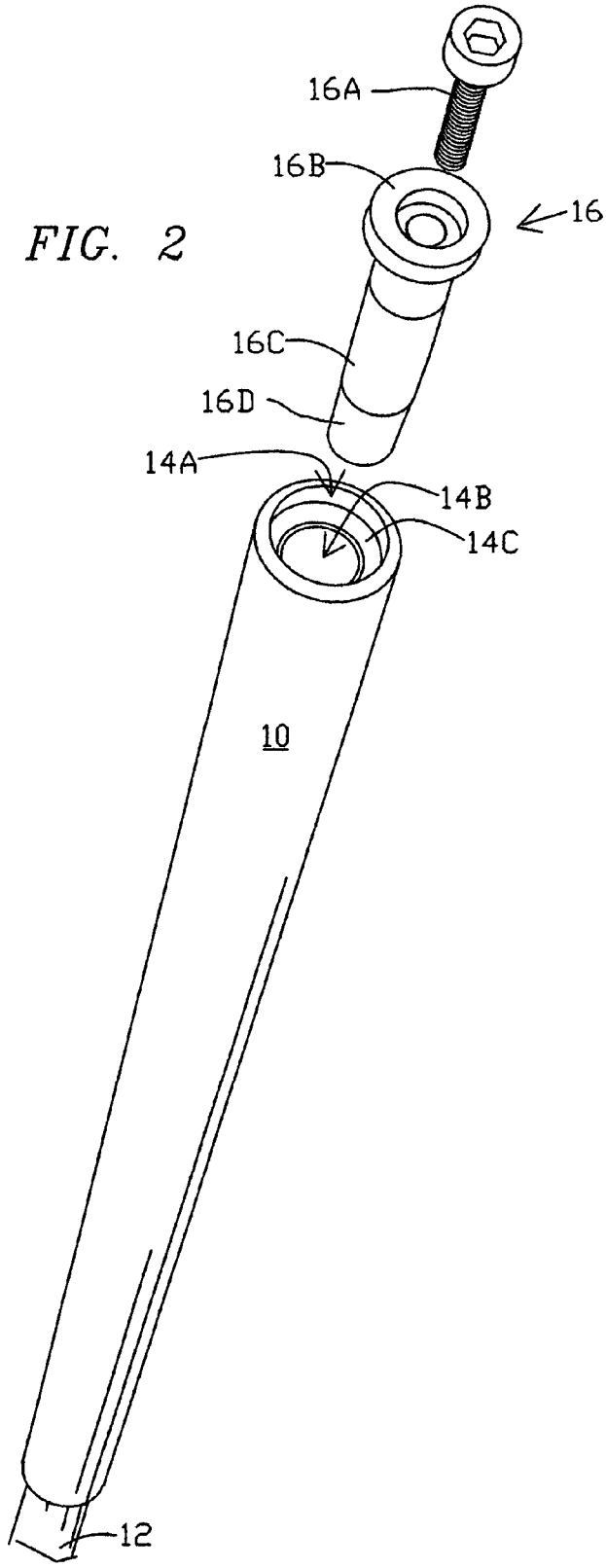
FIG. 2 is a three-dimensional view of the golf grip of FIG. 1, showing a counter-weight assembly structure with the retaining screw removed.

FIG. 2 is a three-dimensional view of the golf grip 10 of FIG. 1, showing cylindrical recess 14A and hole 14B located in the top of grip 10. At the bottom of recess 14A, section of material 14C supports counter-weight assembly 16 by contacting flange piece 16B. Selectable counter-weight assembly 16 fits into recess 14A and hole 14B. Counter-weight assembly 16 has retaining screw 16A holding it together, extending through the center of flange piece 16B, weight 16C, and expanding rubber element 16D. When screw 16A is tightened, expanding rubber element 16D locks counter-weight assembly 16 in place.

The material and design of the flange piece 16B, weight 16C and screw 16A are selected to provide a desired mass. Further variations in the mass of flange piece 16B and weight 16C can be obtained through different designs of flange piece 16B and weight 16C, and the use of lighter and/or heavier materials, e.g. plastic, lead or tungsten, and/or by making weight 16C thicker or thinner than shown. The circular shape is optional. Flange piece 16B may also be configured in various coaxial shapes to provide aesthetic appeal, such as a hexagon, octagon, triangle, square, star, heart, or oval.

Figure 3:
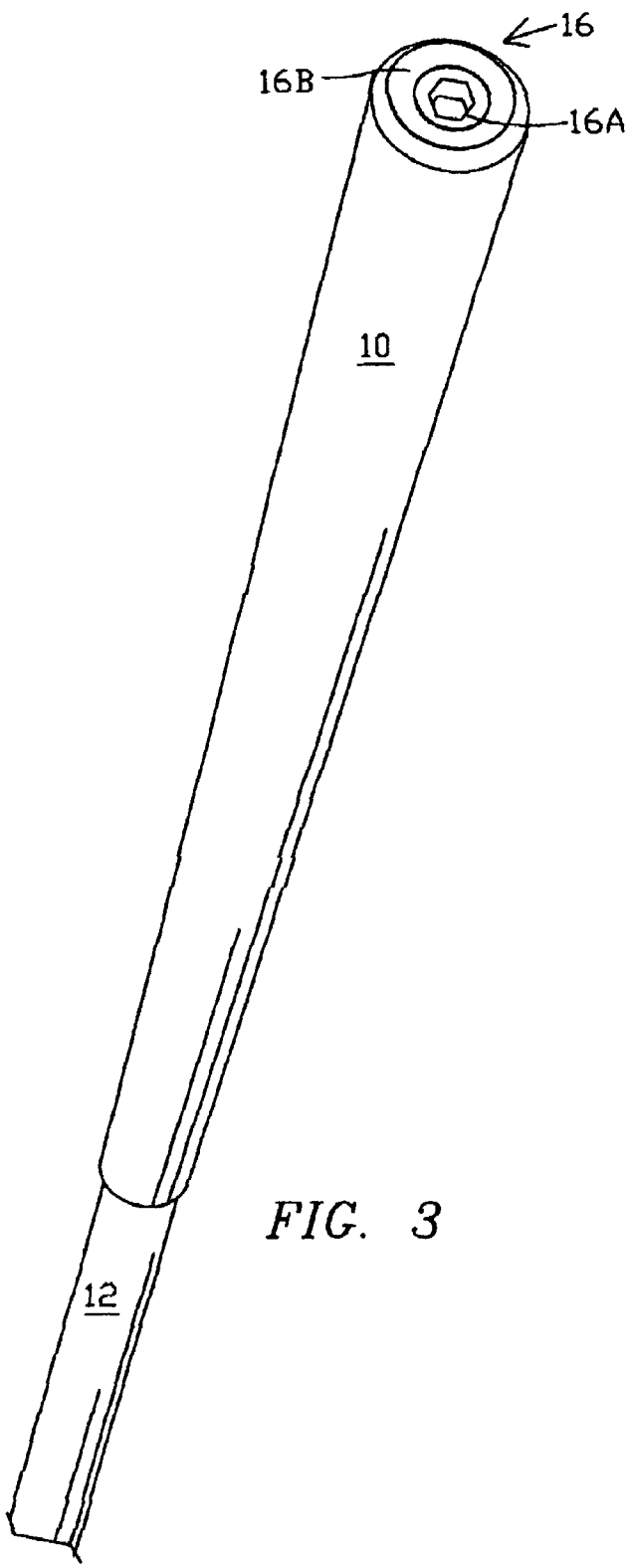
FIG. 3 is a three-dimensional view of the golf grip of FIG. 1 showing the counter-weight assembly installed in the golf club grip.

FIG. 3 is a three-dimensional view of golf grip 10 of FIG. 1, showing counter-weight assembly 16 installed in grip 10. Flange piece 16B is visible. Screw 16A is tightened to lock counter-weight assembly 16 in place. Screw 16A may be loosened to remove selectable weight assembly 16 from grip 10 and shaft 12.

Figure 4:
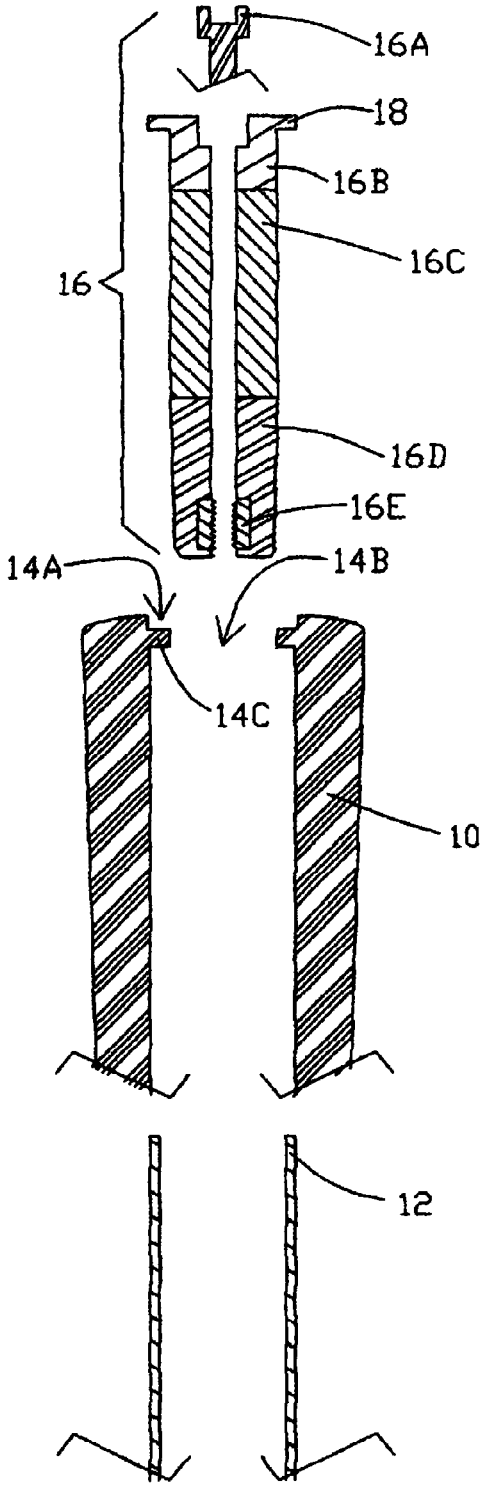
FIG. 4 is a cross-section view taken through the central axis of the golf grip of FIG. 1, showing the counter-weight assembly and retaining screw removed.

FIG. 4 is a cross-section view of golf grip 10 of FIG. 1, taken through the central axis of golf grip 10, showing how grip 10, shaft 12, and selectable counter-weight assembly 16 fit together, with counter-weight assembly 16 and retaining screw 16A removed from hole 14B and shaft 12.

Counter-weight assembly 16 includes stacked pieces: Flange piece 16B, weight 16C, and expanding rubber element 16D. Screw 16A is inserted down the central axis of counter-weight assembly 16 and threads into bushing 16E, thereby holding all the stacked pieces in counter-weight assembly 16 together.

When shaft 12 is fully inserted into grip 10, section of material 14C rests on top of shaft 12. Counter-weight assembly 16 fits into hole 14B and flange 18, on flange piece 16B, fits into recess 14A and rests on top of section of material 14C. Section of material 14C prevents shaft 12 from contacting counter-weight assembly 16, and provides dampening properties to counter-weight assembly 16 and to shaft 12. Section of material 14C on grip 10 is made and arranged to separate flange piece 16B of counter-weight assembly 16 from shaft 12, preventing any contact between the weight 16C and shaft 12, thereby providing a dampening effect on weight 16C and preventing rattling in the assembly.

Figure 5:
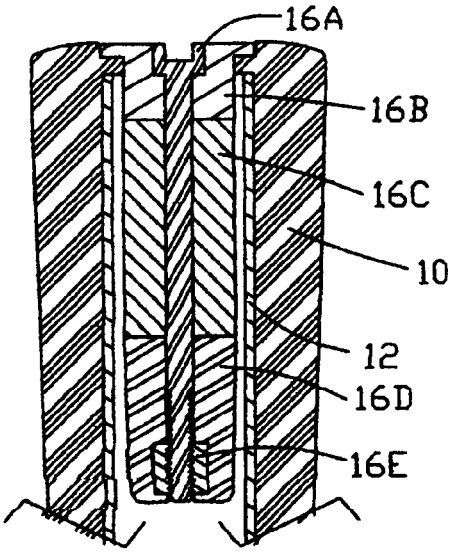
FIG. 5 is a cross section taken through the central axis of the golf grip of FIG. 1, showing the counter-weight assembly in place but not tightened.

FIG. 5 is a cross-section taken through the central axis of golf grip 10, showing grip 10 and shaft 12 and counter-weight assembly 16 fitted together. Flange piece 16B fits completely into grip 10 and shaft 12, fitting flush with the top of grip 10. Retaining screw 16A is a flush fitting socket-head cap screw, which engages bushing 16E to compress flange piece 16B, weight 16C, and expanding rubber element 16D together. The tapered shape and matching outer diameter of counter-weight assembly 16 allow it to easily fit into grip 10 and shaft 12, extending down inside the inner diameter of shaft 12. As shown, screw 16A only holds counter-weight assembly 16 together and is not yet tightened in place.

Figure 6:
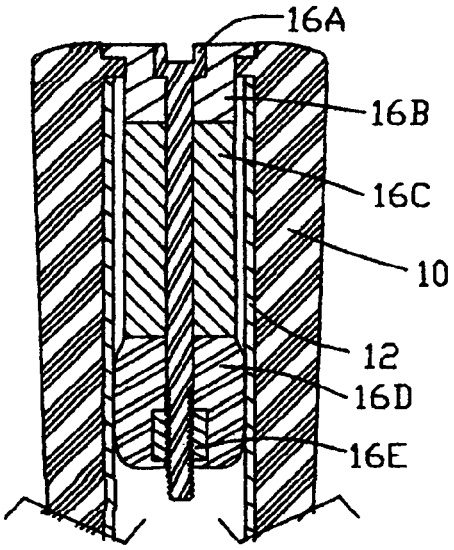
FIG. 6 is a cross section taken through the central axis of the golf grip of FIG. 1 with the retaining screw tightened so as to lock the counter-weight assembly, golf grip and golf club shaft securely together.

FIG. 6 is a cross-section taken through the central axis of golf grip 10, showing grip 10 and shaft 12 and counter-weight assembly 16 locked together. When retaining screw 16 is tightened, bushing 16E moves upward, counter-weight assembly 16 is compressed, including flange piece 16B, weight 16C, expanding rubber element 16D starts to expand radially in the horizontal plane increasing its bearing area and friction force against the inner cylindrical wall of the shaft 12. Under compression, expanding rubber element 16D increases in diameter and contacts the inner diameter of shaft 12, thereby locking the entire structure together. When counter-weight assembly 16 is locked in place with screw 16A, neither flange piece 16B, nor weight 16C, can contact shaft 12, ensuring that the structure will not rattle or vibrate undesirably.

Figure 7:
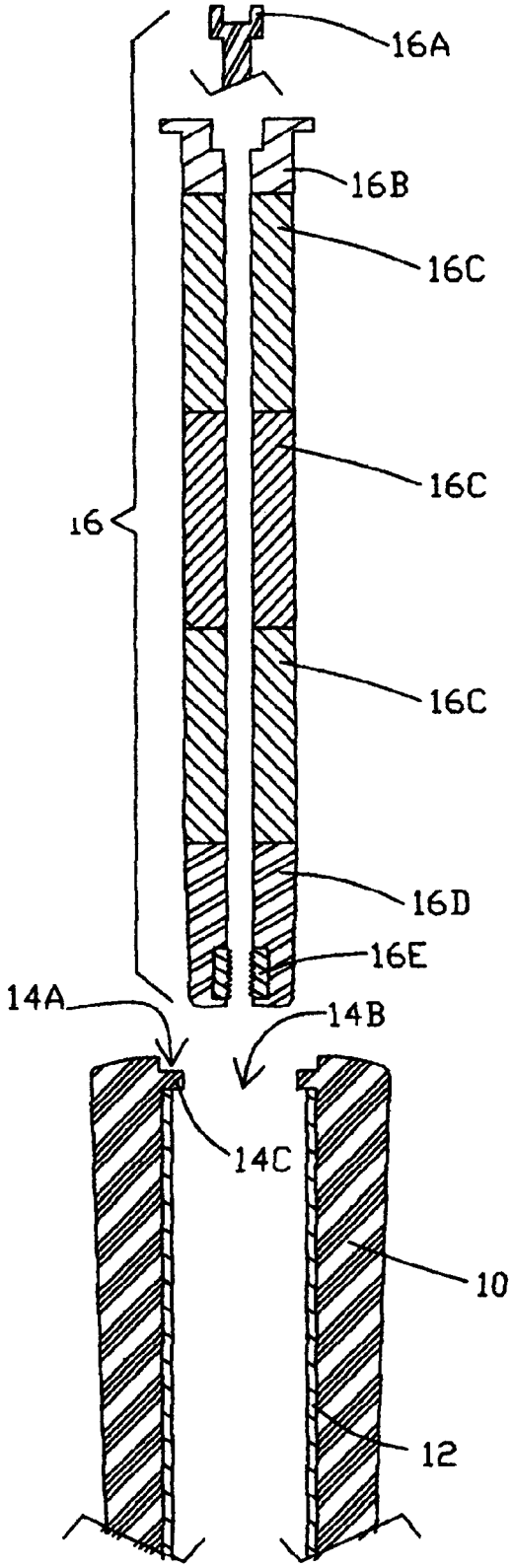
FIG. 7 is a cross-section view taken through the central axis of a golf grip and an alternative counter-weight assembly structure, showing the counter-weight assembly removed.

FIG. 7 is a cross-section taken through the central axis of golf grip 10, showing an alternate counter-weight assembly 16, with three selectable weights 16C located in the center. Selectable weights 16C may be made from various materials and have differing lengths and weights. User, as desired, may also select a varying number of weights 16C. The selected weights 16C may be incorporated into a plug-type structure, including the flange piece 16B and expanding rubber element 16D. Similar to previously disclosed structures, counter-weight assembly 16 is easily interchangeable and fits into recess 14A and hole 14B in the top of grip 10, resting on section of material 14C. When screw 16A is tightened, bushing 16E is compressed, expanding rubber element 16D and locking the entire structure in place by contacting the inner diameter of shaft 12 and preventing any rattling or undesired vibration.

Figure 8:
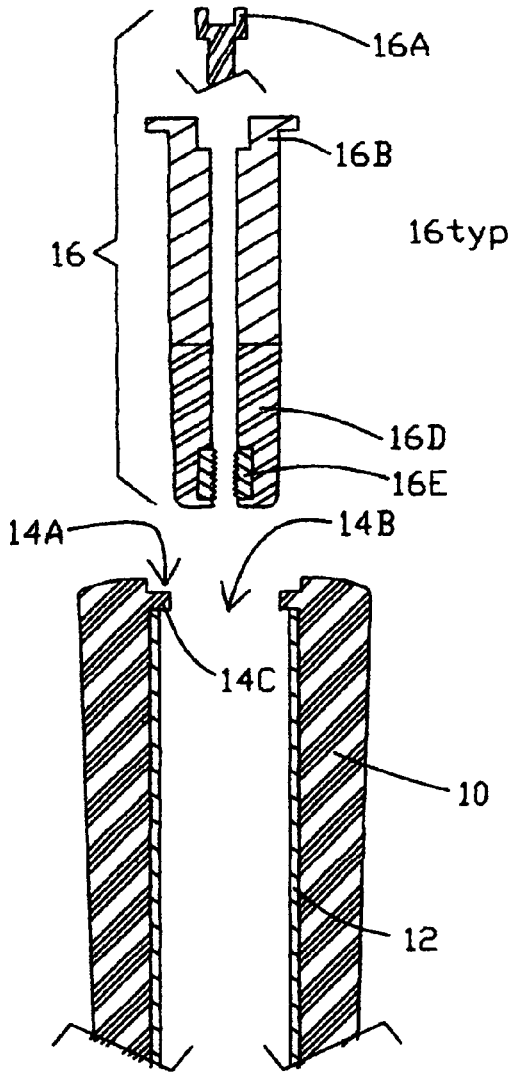
FIG. 8 is a cross-section view taken through the central axis of a golf grip and an alternative counter-weight assembly structure, showing the counter-weight assembly removed.

FIG. 8 is a cross-section taken through the central axis of golf grip 10, showing an alternate counter-weight assembly 16, with an enlarged flange piece 16B. No separate weight is included in the shown counter-weight assembly; flange piece 16B acts as both the weight and the flange holding assembly 16 in place. User, as desired, may select a flange piece of varying length and/or material to affect the mass and location of counter-weight. Similar to previously disclosed structures, counter-weight assembly 16 is easily interchangeable and fits into recess 14A and hole 14B in the top of grip 10, resting on section of material 14C. When screw 16A is tightened, bushing 16E is compressed, expanding rubber element 16D and locking the entire structure in place by contacting the inner diameter of shaft 12 and preventing any rattling or undesired vibration.

Figure 9:
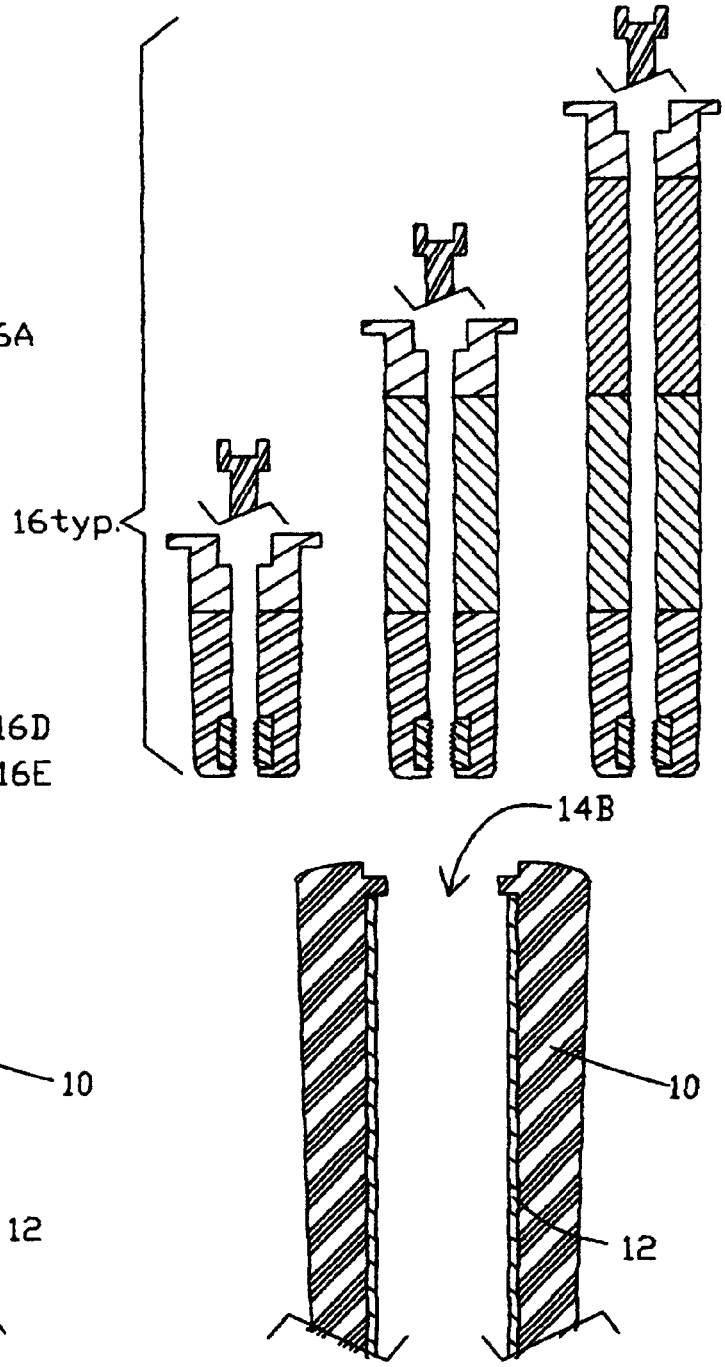
FIG. 9 is a cross-section view taken through the central axis of a golf grip and alternative counter-weight assemblies, showing the easily interchangeable counter-weight assemblies.

FIG. 9 is a cross-section taken through the central axis of golf grip 10, showing how various counter-weight assemblies may be easily interchanged. As the user desires, counter-weight assemblies 16 with differing weights, centers of mass and materials may all be inserted into hole 14B on a single standardized golf grip 10 and shaft 12.

Figure 10:
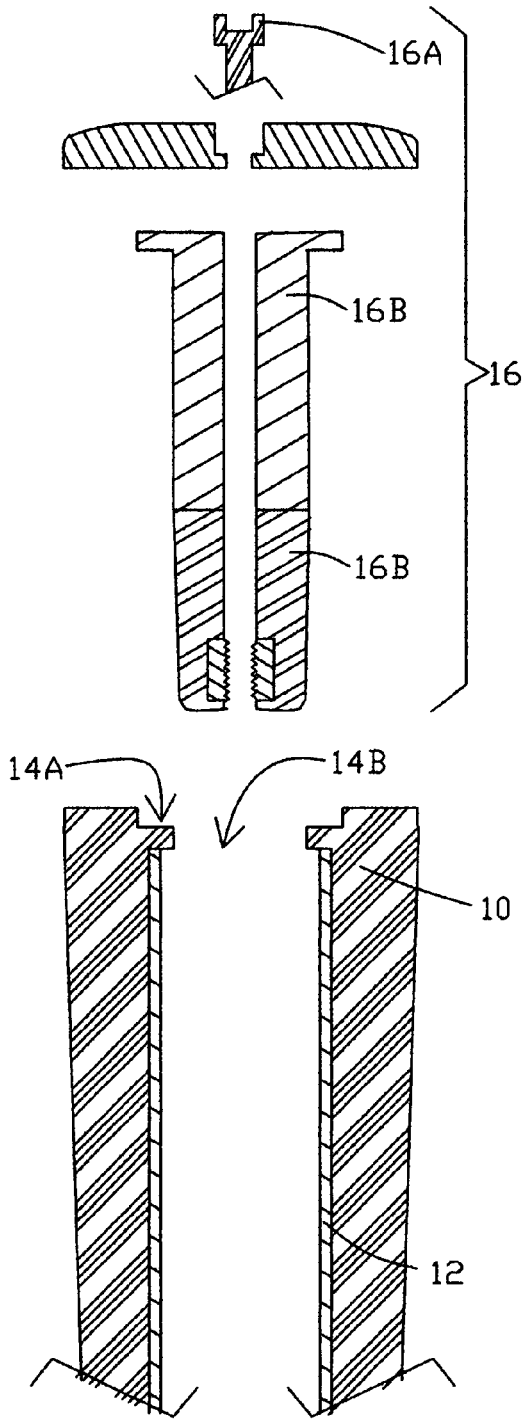
FIG. 10 is a cross-section view taken through the central axis of a golf grip and alternative counter-weight assembly structure, showing a weighted cap on top of the assembly.

FIG. 10 is a cross-section taken through the central axis of golf grip 10, showing an alternate counter-weight assembly 16, with a weighted cap 16F added to the top of flange piece 16B. Weighted cap 16F allows a user to change the counter weighting of a club by interchanging weighted caps 16F with differing masses and materials, as desired. Similar to previously disclosed structures, counter-weight assembly 16 is easily interchangeable and fits into recess 14A and hole 14B in the top of grip 10. When screw 16A is tightened, expanding rubber element 16D is compressed, locking the entire structure in place by contacting the inner diameter of shaft 12 and preventing any rattling or undesired vibration.

Figure 11:
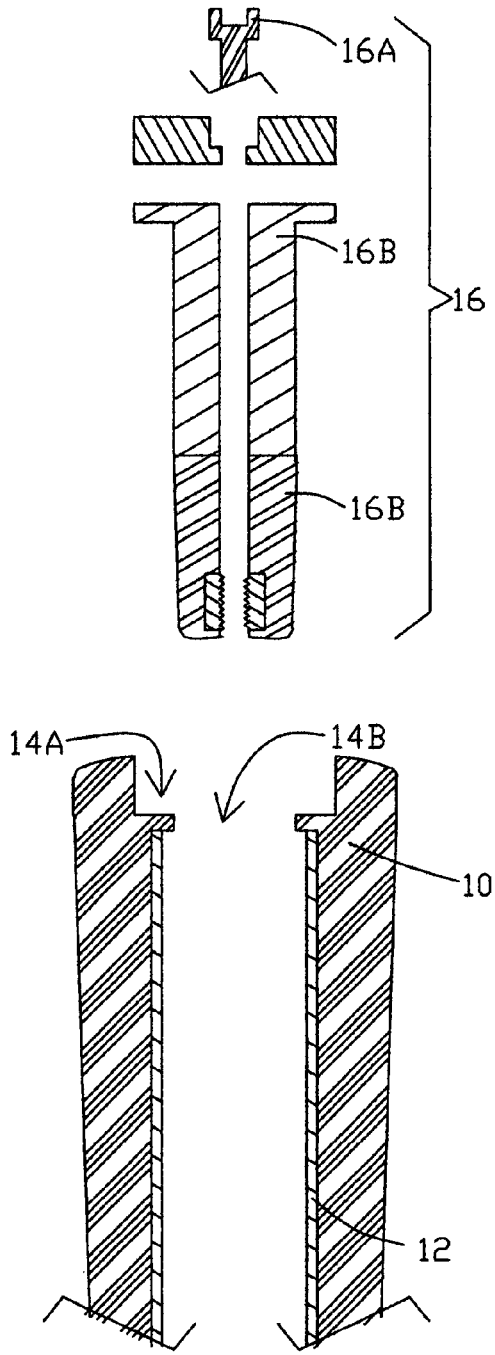
FIG. 11 is a cross-section view taken through the central axis of a golf grip and alternative counter-weight assembly structure, showing an alternative weighted cap on top of the assembly.

FIG. 11 is a cross-section taken through the central axis of golf grip 10, showing an alternate grip structure and counter-weight assembly 16, with deepened recess 14A and weighted cap 16F added to the top of flange piece 16B. Weighted cap 16F allows a user to change the counter weighting of a club by interchanging weighted caps 16F with differing masses and materials, as desired. Similar to previously disclosed structures, counter-weight assembly 16 is easily interchangeable and fits into recess 14A and hole 14B in the top of grip 10. When screw 16A is tightened, expanding rubber element 16D is compressed, locking the entire structure in place by contacting the inner diameter of shaft 12 and preventing any rattling or undesired vibration.

Figure 12:
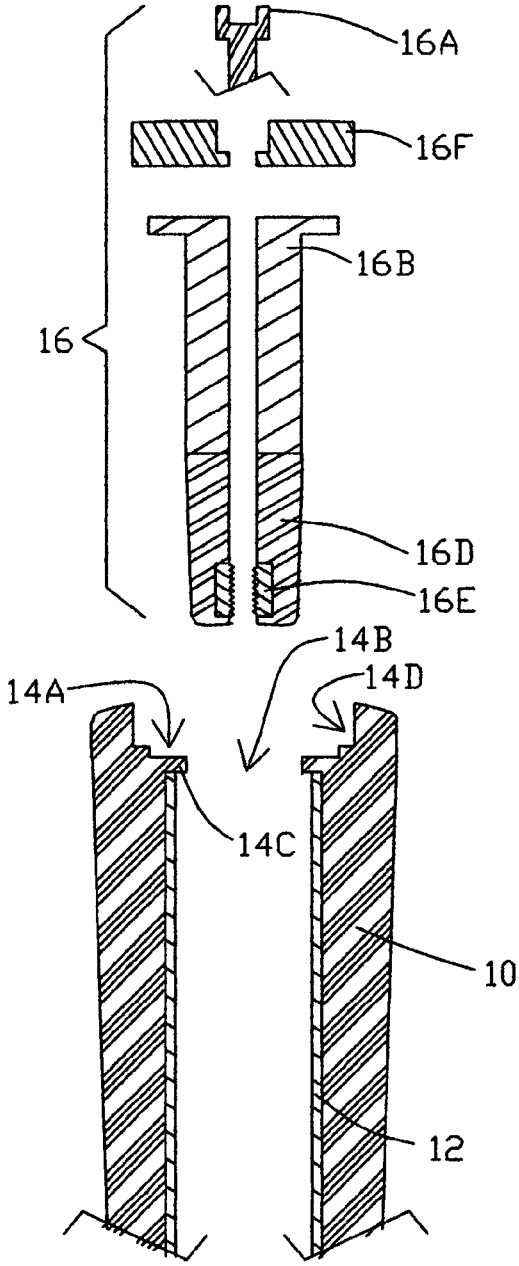
FIG. 12 is a cross-section view taken through the central axis of an alternative golf grip and counter-weight assembly structure, showing an alternative weighted cap on top of the assembly.

FIG. 12 is a cross-section taken through the central axis of golf grip 10, showing an alternate grip structure and counter-weight assembly 16, with deepened recess 14A, second recess 14D, and weighted cap 16F added to the top of flange piece 16B. Second recess 14D allows a larger diameter weighted cap 16F to be fitted to the top of flange piece 16B. Weighted cap 16F allows a user to change the counter weighting of a club by interchanging weighted caps 16F with differing masses and materials, as desired. Similar to previously disclosed structures, counter-weight assembly 16 is easily interchangeable and fits into hole 14B in the top of grip 10. When screw 16A is tightened, expanding rubber element 16D is compressed, locking the entire structure in place by contacting the inner diameter of shaft 12 and preventing any rattling or undesired vibration.

Figure 13:
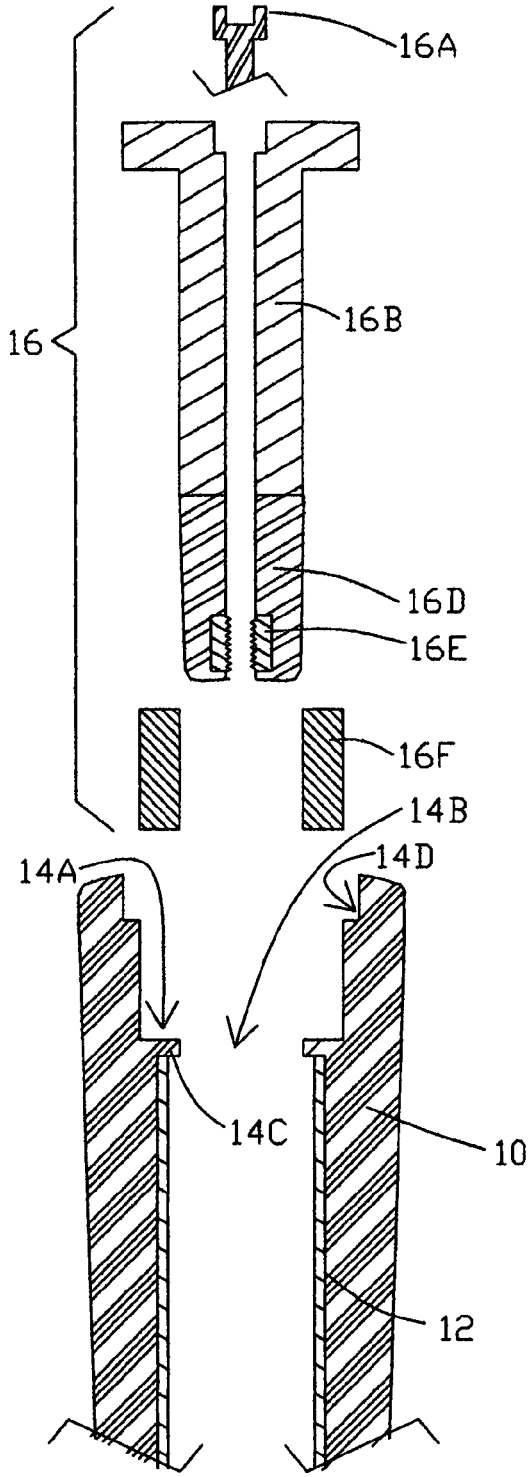
FIG. 13 is a cross-section view taken through the central axis of an alternative golf grip and counter-weight assembly structure, showing an additional coaxial weight.

FIG. 13 is a cross-section taken through the central axis of golf grip 10, showing an alternate grip structure and counter-weight assembly 16, with deepened recess 14A, second recess 14D, and additional weight 16F located under flange piece 16B. Additional weight 16F may be varied in size and material to provide a user with different mass counter-weight options. Similar to previously disclosed structures, counter-weight assembly 16 and weight 16F are easily interchangeable and fit into hole 14B in the top of grip 10. When screw 16A is tightened, expanding rubber element 16D is compressed, locking the entire structure in place by contacting the inner diameter of shaft 12 and preventing any rattling or undesired vibration.

Figure 14:
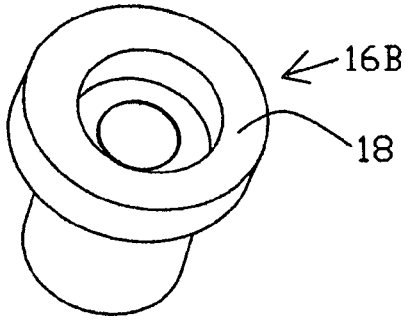
FIG. 14 is a close-up three-dimensional view of the top of an alternative flanged element, part of the counterweight assembly, showing a recess in the top.

FIG. 14 is a close-up three-dimensional view of the top of flange piece 16B, showing the location of flange 18 on the top, which fits into recess 14A (not shown) on golf grip 10 (not shown).

Figure 15:
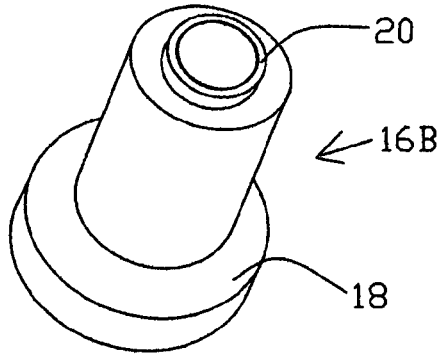
FIG. 15 is a close-up three-dimensional view of the bottom of an alternative flanged element, part of the counterweight assembly, showing a raised lip on the bottom.

FIG. 15 is a close-up three-dimensional view of the bottom of an alternative flange piece 16B, with a raised lip 20 on the bottom of flange piece 16B, located opposite flange 18 on flange piece 16B. Raised lip 20 is made and arranged to interface with a corresponding recess on an attached weight 16C (not shown) or on an attached expanding rubber element 16D (not shown), all which may be stacked together to form a counter-weight assembly. Raised lip 20 provides improved alignment and a surface for applying adhesive to glue stacked pieces together in a counter-weight assembly.

Figure 16:
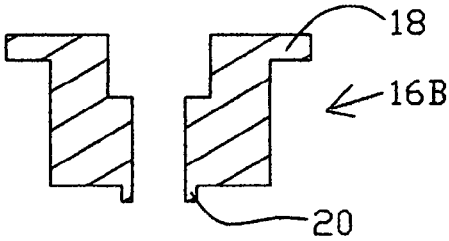
FIG. 16 is a cross-section view taken through the central axis of the flanged element of FIG. 15.

FIG. 16 is a cross-section view taken through the central axis of flange piece 16B of FIG. 15, showing flange 18 on the top and raised lip 20 on the bottom.

Figure 17:
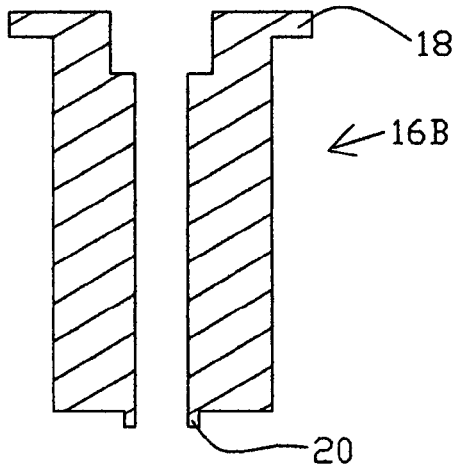
FIG. 17 is a cross-section view taken through the central axis of the flanged element of FIG. 15, with an alternative elongated body.

FIG. 17 is a cross-section view taken through the central axis of the flanged element of FIG. 15, with an alternative elongated body, showing flange 18 on the top and raised lip 20 on the bottom.

Figure 18:
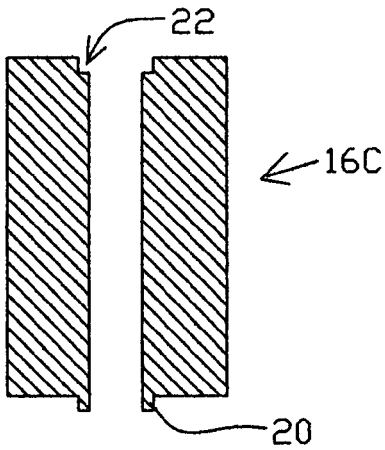
FIG. 18 is a cross-section view taken through the central axis of an alternative weight structure, part of the counter-weight assembly, showing a raised lip on the bottom and an interlocking recess on the top.

FIG. 18 is a cross-section view taken through the central axis of an alternative weight structure 16C, part of a counter-weight assembly (not shown), showing raised lip 20 on the bottom and an interlocking recess 22 on the top. Raised lip 20 and interlocking recess 22 provide improved alignment and surfaces for applying adhesive to glue stacked pieces together in a counter-weight assembly.

Figure 19:
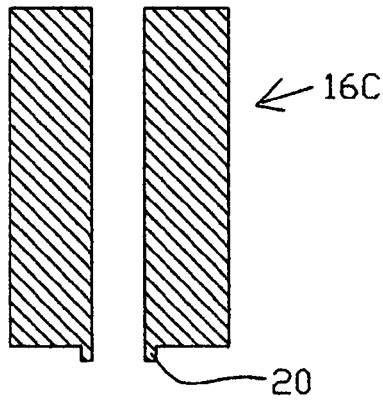
FIG. 19 is a cross-section view taken through the central axis of an alternative weight structure, part of the counter-weight assembly, showing a raised lip on the bottom.

FIG. 19 is a cross-section view taken through the central axis of an alternative weight structure 16C, part of the counterweight assembly (not shown), showing raised lip 20 on the bottom The present invention may be practiced with alternatives to the shape shown for flange piece 16B, e.g. it could be made partially tapered in a lower region, or it could be made cylindrical, optionally rounded or chamfered at the lower end. As further variations, it could be shaped as a polygon in cross-section and/or fluted. Flange piece 16B may be used as an additional plug, with or without a threaded bushing inside to provide more gripping force.

The present invention can be practiced with alternatives to the shape shown for the upper end of grip body 10, e.g. there can be no cylinder cavity to house coinciding weight, there can be an etched ring on the interior cavity to allow plug to be placed without adhesive and removable.

The present invention can be practiced with alternatives to the shape shown for the weights 16C and weight additions 16F, e.g. weights can be only end cap, which would cover the whole top of grip that had no cavity, the form of a disk, both the end cap and disk combined, and variances of mass and size.

Bushing 16E can be bonded in place in the molding of the expanding rubber element 16D. As an option for increased holding force and accommodation of softer and more compliant material in expanding rubber element 16D, bushing 16E could be provided with a radially extending flange at its lower end to bear against the bottom surface of the assembly in the manner of an inverted T-nut.

In another alternative, weight 16C and/or weight addition 16F, and screw 16A could be combined as a single element.

As an alternative, the top of grip 10 may be flat or curved, concave or convex.

As an alternative, recess 14A and/or second recess 14D in the grip may be round, or another radial shape, such as a triangle, square, pentagon, hexagon, octagon, star shape, etc.

As an alternative, the weighted cap 16F may be round, curved, flat, or another radial shape, such as a triangle, square, pentagon, hexagon, octagon, star shape, etc.

As an alternative, the screw 16A may be a cap screw, a countersunk screw, an oval head screw, a flathead screw, or of another type known in the art.

In addition to the purely coaxial shape shown for the exterior of the grip, which is conventional for woods and irons, the invention may also be readily practiced with variations in the external shape of the grip, for example reverse taper grips, the D-shaped cross-section and oval end shape found on putters and any conforming grip approved by the USGA.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A golf club grip of resilient material directed to accommodating addition of a counter-weight assembly in a golf club having a known shaft of hard material in a manner that prevents any direct contact between the shaft and any hard material in the counter-weight assembly by interposing resilient material therebetween, comprising:

a grip body, of resilient material, configured internally with a cylindrical main bore that extends coaxially and uniformly over a major portion of the grip body down to the lower end, and a cylindrical cavity that extends upwardly, coaxial with the shaft, to a top opening at the upper end of the grip body, extending uniformly to the top opening with a diameter no less than that of the main bore;

an annular flange formed integrally from the resilient material, disposed between the main bore and the cavity, extending inwardly to a circular flange opening, coaxial with the shaft, thus defining a limit of shaft insertion and dimensioning the cavity with a perimeter greater than that of the flange opening; and an interchangeable weight plug, for installation in the cavity of said golf grip, comprising:

a primary cylindrical weight element of predetermined weight having an outer diameter dimensioned to pass through the annular flange opening and having a central screw clearance opening;

a cylindrical expansion element of compliant material having an outer diameter dimensioned to pass through the annular flange opening and having a central screw clearance opening;

a threaded member located at a lower region of the expansion element; and a machine screw having a main threaded shaft traversing, in order, the weight element, and the expansion element, and threadedly engaging the threaded member, the bolt head being configured with a top-accessible drive tool recess by which, with a mating drive tool, the machine screw can be rotated relative to the other elements, such that said weight plug, inserted into the shaft, may be secured in place for playing golf by rotating the machine screw to apply pressure that expands the expansion element radially to become tightly compressed against inner surfaces of the shaft, and said weight plug can be removed for replacement by another weight plug of different mass by rotating the machine screw to release the expansion element from the shaft.

2. The golf club grip as defined in claim 1, wherein said weight element is configured with an exposed flat top surface located generally flush with a flat top surface of said grip body, the head of the machine screw being countersunk into an upper region of said weight element.

3. The golf club grip as defined in claim 1 further comprising at least one additional cylindrical weight element of predetermined mass disposed between said primary cylindrical weight element and said cylindrical expansion element.

* * * * *